US006761543B2

(12) United States Patent
Choi et al.

(10) Patent No.: US 6,761,543 B2
(45) Date of Patent: Jul. 13, 2004

(54) PISTON OPERATING ASSEMBLY FOR A LINEAR COMPRESSOR AND METHOD FOR MANUFACTURING THE SAME

(75) Inventors: Kyung-shik Choi, Suwon (KR); Chal-gi Jo, Kwangju (KR)

(73) Assignee: Samsung Kwangju Electronics,Co., Ltd., Kwangju (KR)

( * ) Notice: Subject to any disclaimer, the term of this patent is extended or adjusted under 35 U.S.C. 154(b) by 0 days.

(21) Appl. No.: 09/834,344

(22) Filed: Apr. 12, 2001

(65) Prior Publication Data

US 2002/0057973 A1 May 16, 2002

(30) Foreign Application Priority Data

Nov. 10, 2000 (KR) ..... 2000-66866

(51) Int. Cl.[7] ..... F04B 35/04
(52) U.S. Cl. ..... 417/415; 417/417
(58) Field of Search ..... 417/417, 415

(56) References Cited

U.S. PATENT DOCUMENTS 5,993,175 A * 11/1999 Kim et al. ..... 417/417
6,024,544 A * 2/2000 Kim et al. ..... 417/417
6,379,125 B1 4/2002 Tojo et al. ..... 417/417

FOREIGN PATENT DOCUMENTS

CN 1200789 12/1998
EP 0 864 750 A1 9/1998

OTHER PUBLICATIONS

US 2001/0014292 A1, Kawahara et al., Pub. date: Aug. 16, 2001.*
US 2001/0055535 A1, Kawahara et al., Pub. date: Dec. 27, 2001.*

* cited by examiner

*Primary Examiner*—Charles G. Freay
*Assistant Examiner*—William H. Rodriguez
(74) *Attorney, Agent, or Firm*—Westman, Champlin & Kelly, P.A.

(57) ABSTRACT

An integrated piston operating assembly for a linear compressor and a method for manufacturing the same are provided. The integrated piston operating assembly includes a piston coupling boss coupled to a piston, a plurality of magnets disposed in a cylindrical arrangement concentric with the piston coupling boss, and a linking member formed of a resin for connecting and thus integrating the piston coupling boss with the plurality of magnets. The magnets and piston coupling boss are secured to the linking member as the linking member is injection molded. By integrating the piston operating assembly of the linear compressor, geometric and assembling tolerances are improved, while deterioration of persistence due to processing and assembling processes is prevented.

4 Claims, 7 Drawing Sheets

PISTON OPERATING ASSEMBLY FOR A LINEAR COMPRESSOR AND METHOD FOR MANUFACTURING THE SAME

BACKGROUND OF THE INVENTION

1. Field of the Invention

The present invention relates to a linear compressor for compressing refrigerant by using a reciprocating piston. More particularly, the present invention relates to a piston operating assembly for the linear compressor and a method for manufacturing the same.

2. Description of the Prior Art

Generally, a linear compressor compresses a refrigerant by reciprocating a piston with a changing magnetic field. Such a compressor is shown in FIGS. 1 through 3.

As shown in the drawings, the linear compressor includes a cylinder portion 10, a piston 20, a piston operating assembly 30 and an external lamination portion 40, all of which are disposed in a chamber 1.

As shown in FIG. 2, the piston operating assembly 30 includes a magnet holder 32, which is a hollow cylinder having a hole formed in an outer circumference thereof, a magnet 33 inserted in the hole of the magnet holder 32, a magnet cover 35 press fit on the outer circumference of the magnet holder 32 to prevent any accidental separation of the magnet 33 from the magnet holder 32, and a linking member 31 having a hole formed on the center portion thereof for receiving the piston 20. The linking member 31 is connected to one end of the magnet holder 32.

The piston 20 is a hollow cylinder, having one end attached to a suction valve 25 and the other end coupled to the linking member 31 of the piston operating assembly 30. The piston 20 can be secured to the linking member 31 by one of a number of methods, such as welding, etc.

The cylinder portion 10 includes a cylinder 11, in which the piston 20 is received for reciprocating movement, an internal lamination 13 inserted about the outer circumference of the cylinder 11, and a coil 15 wound about the center portion of the internal lamination 13.

An external lamination portion 40 includes an external lamination 41 formed a predetermined distance from the internal lamination 13, a housing 43 for supporting the external lamination 41, and a frame 42.

The operation of the linear compressor constructed as above will be described below.

First, when Alternating Current (AC) voltage is applied to the coil 15 of the internal lamination 13, a magnetic field having N-S poles is generated between the internal and external laminations 13 and 41, respectively. Due to the presence of the permanent magnet 33 disposed between the internal and external laminations 13 and 41, a force in an axial direction is generated according to Flemming's left-hand rule. As the N-S poles of the magnet 33 are varied, the magnet 33 reciprocates, and accordingly, the piston 20 also reciprocates.

Next, a refrigerant is introduced into the chamber 1 through an inlet tube 3 by the reciprocating movement of the piston 20. The refrigerant flows through the piston 20 and the suction valve 25 and into a compressing chamber 5. When the refrigerant is compressed in the compressing chamber 5, the refrigerant is then discharged through an outlet tube 7.

The conventional linear compressor, however, has several shortcomings. First, some parts of the compressor require forceful coupling methods, such as force fit, welding, etc., to secure the parts together. For example, the piston 20 and linking member 31 are welded together, as are the linking member 31 and the magnet holder 32. Further, the magnet holder 32 must undergo processes like cutting, punching and welding. The force of the couplings and heat distortion of the respective parts produce an internal stress that affects the integrity of the parts. Further, the conventional linear compressor has a complex and lengthy assembly process, while producing a high possibility of defective products. As a result, productivity and throughput are deteriorated.

The manufacturing process of the magnet holder 32 is described in greater detail with reference to FIG. 3. First, a metal plate 32*a* of a predetermined size is prepared. Then, the metal plate 32*a* undergoes a rolling process. Next, the ends of the metal plate 32*a* are welded together to form a hollow cylinder 32*b*. The hollow cylinder 32*b* is then punched to form a plurality of holes 32*c* therein. Finally, in order to prevent any accidental separation of the magnets 33 from the hollow cylinder 32*b*, a magnet cover 35 is force fit onto the outer circumference of the hollow cylinder 32*b*.

In the conventional linear compressor, the different sizes of and deviations among the magnets 33 make it difficult to press fit or force fit the magnet cover 35. When the magnet cover 35 is forcefully press fit, without taking into consideration the different sizes of the magnets 33, those magnets 33 that are more fragile can be broken.

Further, according to a conventional way of assembling the piston operating assembly 30 of the linear compressor, an error in concentricity occurs when the piston 20 and the magnet holder 32 are welded to the linking member 31, and errors in circularity and concentricity occur when press fitting the magnet 33, which is press fit in the magnet holder 32, in the magnet cover 35. Accordingly, productivity and throughput deteriorate. Further, since there are numerous parts that must be assembled together, all of which affect the geometric tolerance of the piston operating assembly 30, the assembly tolerance is increased due to an accumulation of the tolerances of the respective parts. When the geometric tolerance and the assembly tolerance exceed a predetermined degree, the same becomes a defect factor, which can cause problems, such as a malfunction of the linear compressor, etc.

In addition, in the conventional method of assembling the linear compressor, a non-magnetic metal is used to form the magnet holder 32, thereby preventing a leakage of the magnetic force from the magnet 33. The non-magnetic metal of the conventional linear compressor, however, has a relatively higher conductivity, which hinders a complete absence of the magnetic force leakage from the magnet 33. Accordingly, due to the leakage of the magnetic force from the magnet 33, the compression efficiency of the linear compressor is negatively affected.

SUMMARY OF THE INVENTION

The present invention has been made to overcome the above-mentioned problems of the prior art. Accordingly, it is an object of the present invention to provide a piston operating assembly for a linear compressor having a piston coupling boss coupled with a piston, a plurality of magnets, and a linking member. The linking member connects the piston coupling boss with the magnets, all of which are integrally secured to the linking member when the linking member is injection molded. Thus, the integrated piston operating assembly has improved geometric and assembling tolerances and no deterioration of persistence.

It is another object of the present invention to provide a method for manufacturing a piston operating assembly for a linear compressor. In the present method the processes are simplified while resulting in a higher productivity.

The above object is accomplished by a piston operating assembly of a linear compressor for compressing a refrigerant with a piston that linearly reciprocates due to a magnetic field. The piston operating assembly includes a piston coupling boss for coupling to the piston, a plurality of magnets disposed in a cylindrical arrangement concentric with respect to the piston coupling boss, and a linking member for connecting and thus integrating the piston coupling boss and the plurality of magnets. The linking member is formed of an injection molded resin, and the piston coupling boss and the magnets are coupled to the linking member at the same time that the linking member is injection molded.

Each of the magnets has a stepped portion that is formed along a boundary thereof.

The above object is also accomplished by a method for manufacturing a piston operating assembly for a linear compressor. The method includes the steps of preparing a plurality of magnets and a piston coupling boss, assembling the plurality of magnets and the piston coupling boss in a core mold, and mounting the core mold in an injection molding machine. The method further includes injecting a molding resin into the core mold to form an integrated piston operating assembly, with the plurality of magnets and the piston coupling boss fixed in the molding resin. The completed integrated piston operating assembly is then separated from the core mold, once the injection molding is finished.

Accordingly, the piston operating assembly of the linear compressor has improved geometric and assembling tolerances and persistence. In addition, the method of manufacturing such piston operating assembly is greatly simplified and results in an increase in productivity.

BRIEF DESCRIPTION OF THE DRAWINGS

The above objects and other features and advantages of the present invention will become readily apparent by reference to the following detailed description when considered in conjunction with the accompanying drawings, in which.

DETAILED DESCRIPTION OF THE PREFERRED EMBODIMENT

The preferred embodiment of the present invention will be described below with reference to the accompanying drawings.

Figure 6:
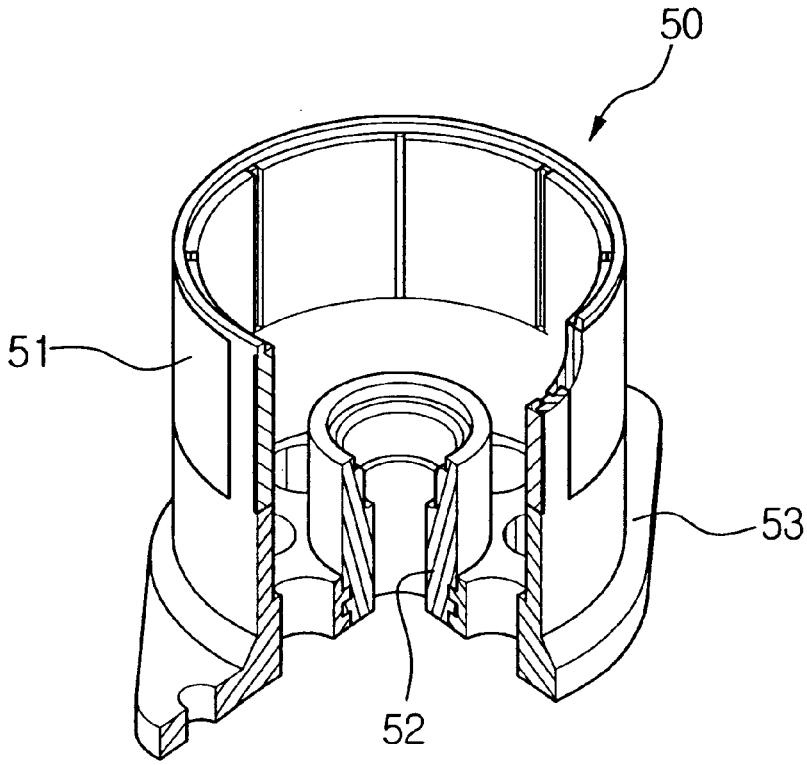
FIG. 6 is a perspective view of the piston operating assembly for the linear compressor, in accordance with the present invention.

FIG. 6 is a perspective view of a piston operating assembly 50 for a linear compressor in accordance with the present invention.

The piston operating assembly 50 includes a plurality of magnets 51 disposed in a cylindrical arrangement and spaced from each other at equal intervals, a hollow piston coupling boss 52 concentrically disposed within the cylindrical arrangement, and a linking member 53 for connecting the cylindrical arrangement to an end of the piston coupling boss 52. The magnets 51, piston coupling boss 52, and linking member 53 are preferably secured together simultaneously with the formation of the linking member 53.

Figure 5:
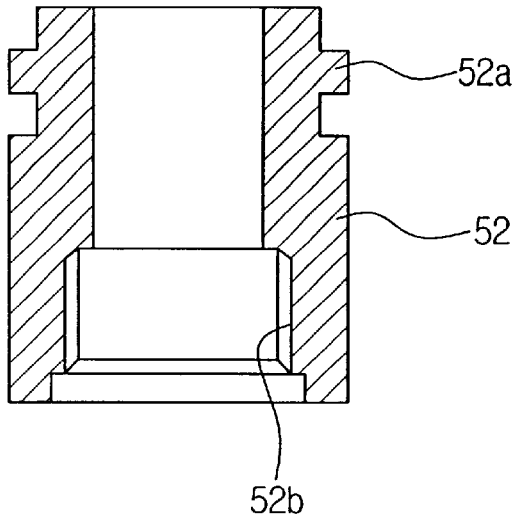
FIG. 5 is a sectional view of a piston coupling boss, which is employed in the piston operating assembly for the linear compressor, in accordance with the present invention.

In order to compress a refrigerant, a piston reciprocates in the cylinder of a linear compressor. The piston operating assembly, which moves the piston within the cylinder of the compressor, includes a piston coupling boss 52 that has a screw portion 52*b* (FIG. 5). The screw portion 52*b* includes threads that engage the threads formed at one end of the piston. The integrated piston operating assembly is preferably injection molded using a molding resin. As shown in FIG. 5, in order to increase the coupling force between the piston coupling boss 52 and the molding resin, a female screw portion 52*b* is formed in one end of the piston coupling boss 52, while a raised portion 52*a* is formed at the opposite end. It is further preferable that the piston coupling boss 52 is made of a brass.

Figure 1:
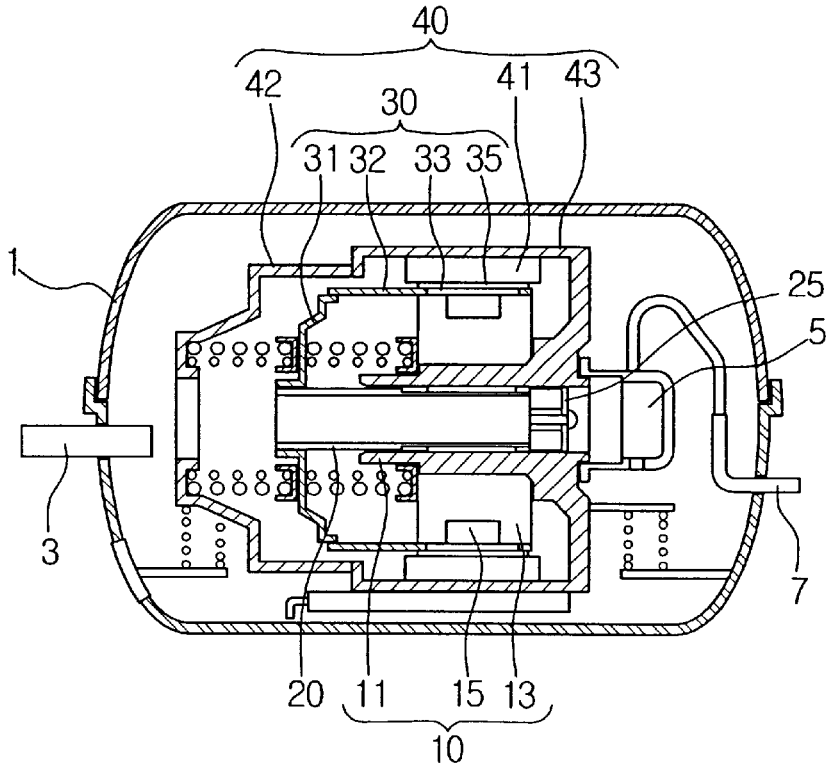
FIG. 1 (PRIOR ART)
FIG. 1 is a sectional view of a conventional linear compressor.
Figure 2:
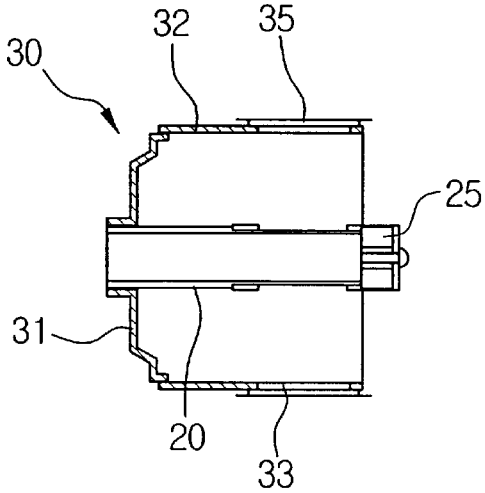
FIG. 2 (PRIOR ART)
FIG. 2 is a sectional view of a piston operating assembly for the conventional linear compressor of FIG. 1.
Figure 3:
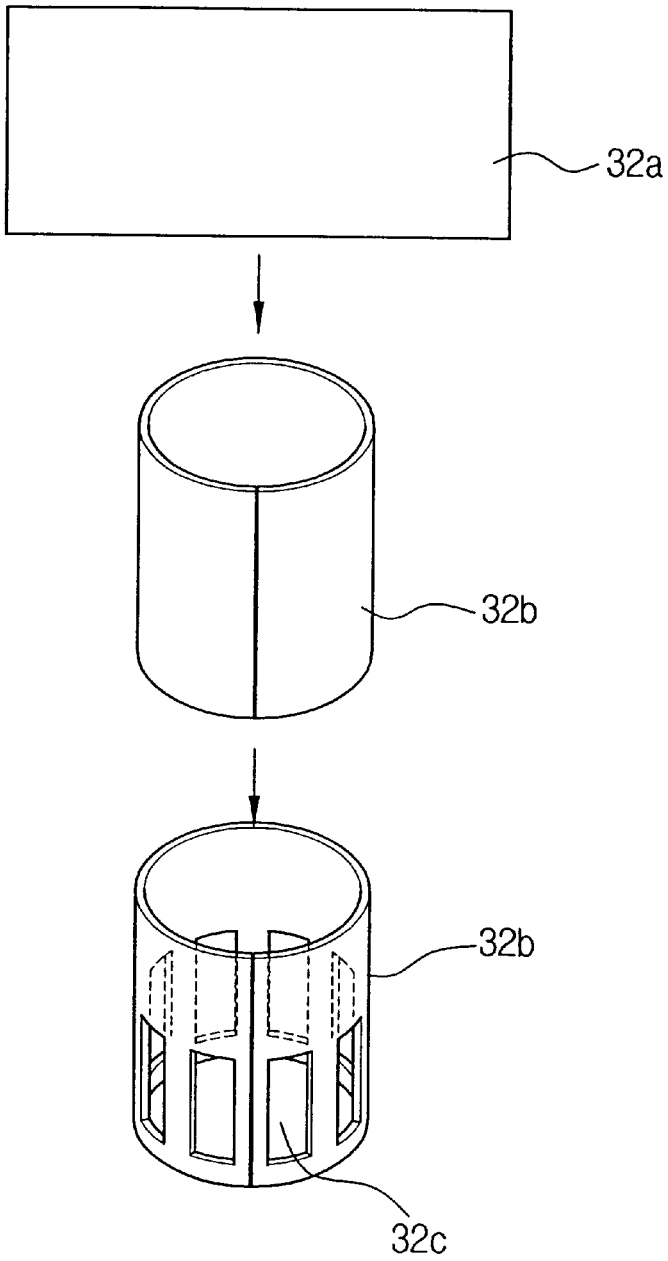
FIG.3 (PRIOR ART)
FIG. 3 illustrates the steps for manufacturing a conventional magnet holder for the conventional linear compressor of FIG. 1.
Figure 4:
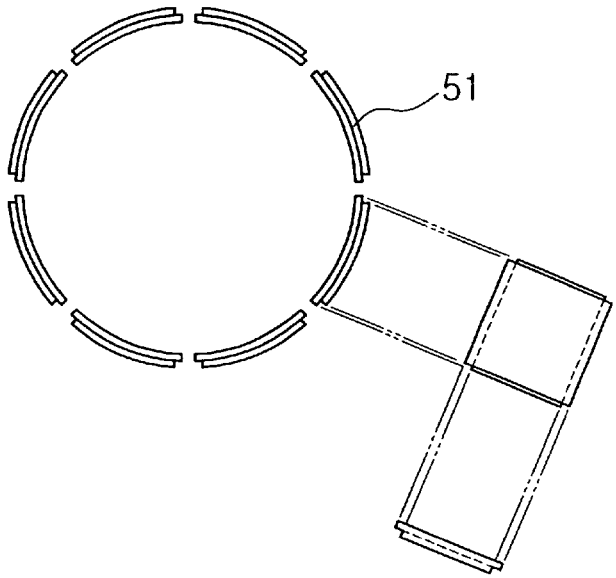
FIG. 4 is a plan view of a plurality of magnets, which are employed in a piston operating assembly for a linear compressor, in accordance with the present invention.

Because of the changes of magnetic field between the internal and external laminations 13 and 41, the magnets 51 cause the piston to reciprocate. Each magnet 51 has a stepped portion formed around its boundary. As shown in FIG. 4, each magnet 51 is a square plate having a predetermined radius of curvature. The two opposite sides of the magnet 51 are processed to have an L-shaped cross-section, while the other two opposite sides of the magnet 51 are processed to have an upended L-shaped cross-section. By processing the sides of the magnet 51 to have L-shaped and upended L-shaped cross-sections, the coupling force between the piston operating assembly 50 and the molding resin is increased when the piston operating assembly 50 is integrally formed by injection molding.

The molding resin is preferably a non-magnetic and non-conductive thermosetting resin, such as a bulk molding compound composed of polyester as a main material, glass fiber as a reinforcing material, filler, and catalyst, etc.

In the piston operating assembly 50 for the linear compressor of the present invention, since the piston coupling boss 52 and the plurality of magnets 51 are integrally formed in the integrated molding resin, which forms the linking member 53, the separate process steps of assembling the magnets 51 and press fitting the magnet cover 35 are no longer required. In addition, the assembly of the piston is completed by screwing the piston onto the piston coupling boss 52.

The integrated piston operating assembly 50 reciprocates due to a changing magnetic field, which is generated by the internal lamination 13 and coil 15 disposed within the cylindrical arrangement of magnets 51, and the external lamination 41 disposed outside the cylindrical arrangement of magnets 51. When the piston operating assembly 50 reciprocates, the piston, which is coupled with the piston operating assembly 50, also reciprocates linearly within the cylinder. Accordingly, the refrigerant is drawn into the compressing chamber and then compressed.

Figure 7A:
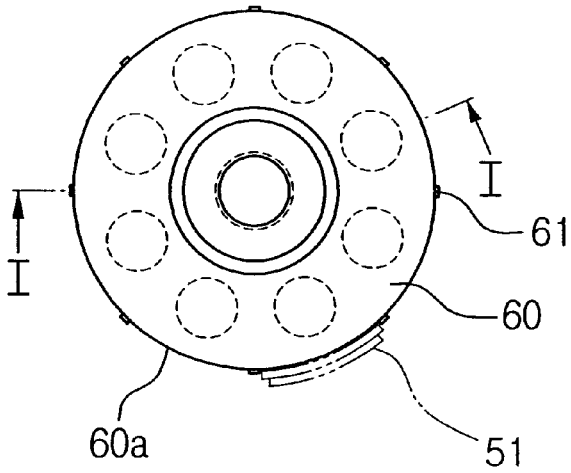
FIG. 7A is a plan view of a core mold, which is used to manufacture the piston operating assembly of FIG. 6.
Figure 7B:
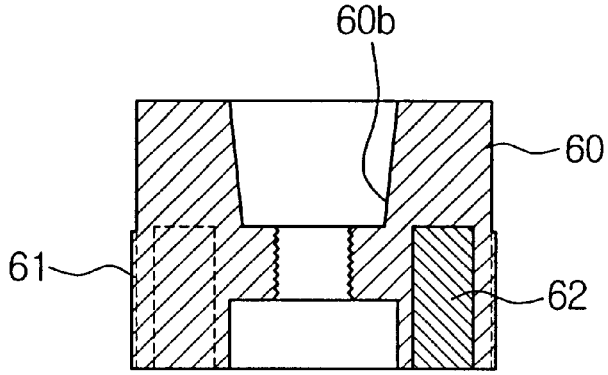
FIG. 7B is a cross-sectional view taken generally along the line I—I of FIG. 7A.
Figure 8:
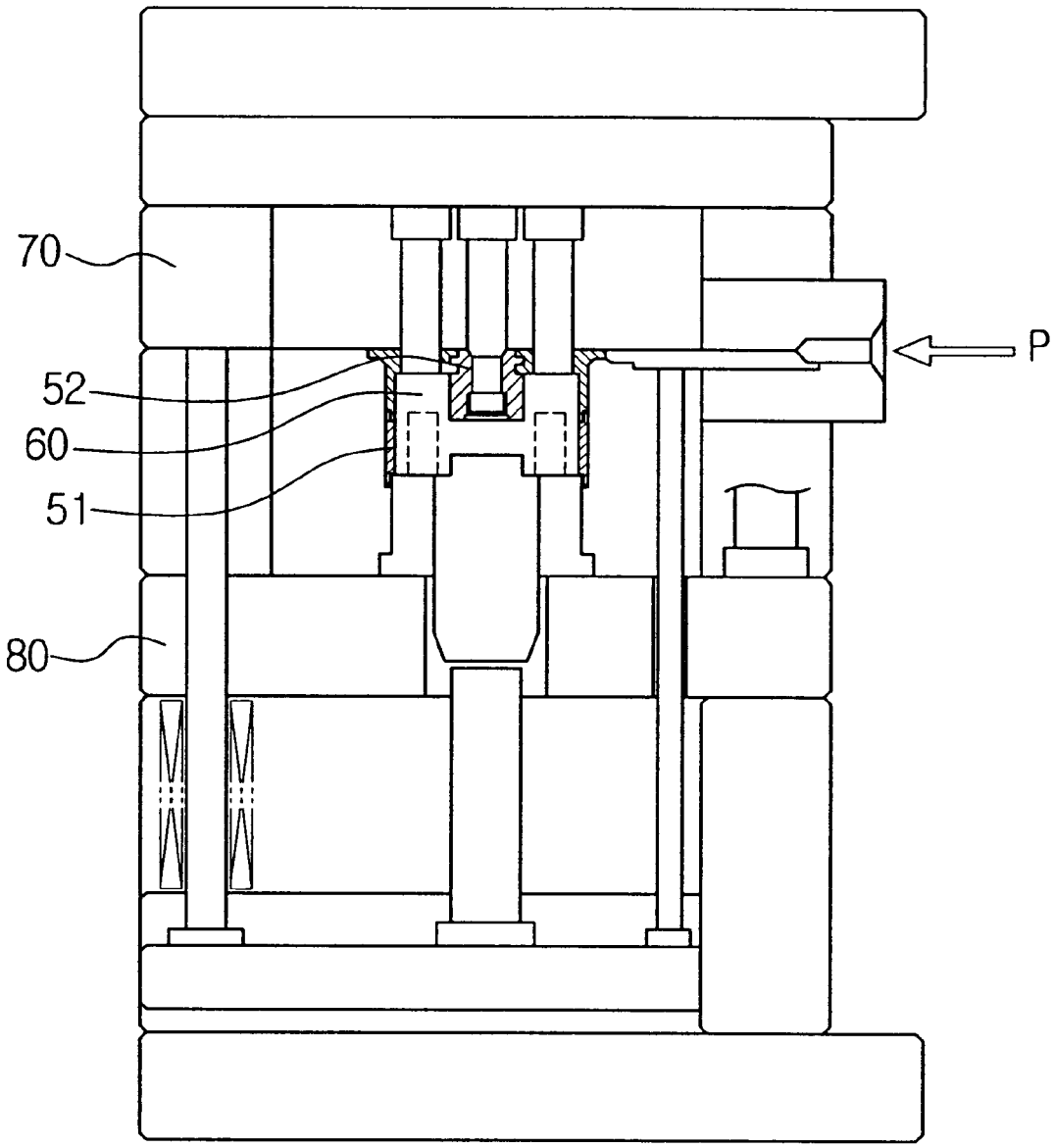
FIG. 8 is a sectional view of the core mold of FIGS. 7A and 7B shown mounted in an injection molding machine during manufacture of the piston operating assembly of FIG. 6.

A method for manufacturing the piston operating assembly 50 for the linear compressor in accordance with the preferred embodiment of the present invention will be described below with reference to FIGS. 7–9.

Figure 9:
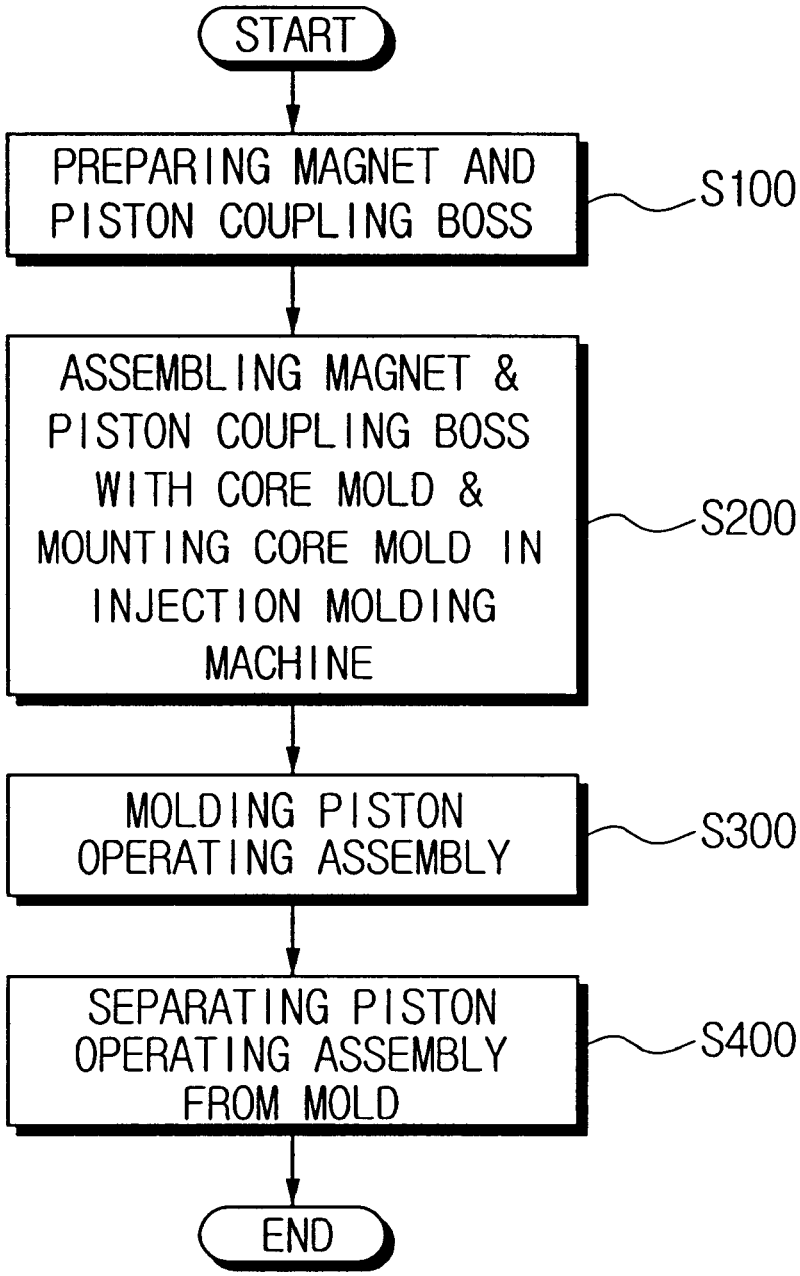
FIG. 9 is a flow chart illustrating the steps in a method for manufacturing the piston operating assembly of FIG. 6.

As illustrated in FIG. 9, the method for manufacturing the integrated piston operating assembly 50 includes the steps of preparing a plurality of magnets 51 and a piston coupling boss 52 (step S100), assembling the plurality of magnets 51 and the piston coupling boss 52 in a core mold 60 (FIGS. 7A and 7B) and mounting the core mold 60 in an injection molding machine (step S200), integrally injection molding the piston operating assembly 50 with the plurality of magnets 51 and the piston coupling boss 52 (step S300), and then separating the completed the piston operating assembly 50 for the linear compressor from the core mold 60 when the molding process is finished (step S400).

In the preparation step S100, the magnets 51 and the piston coupling boss 52, which are made by separate processes, are prepared for assembly into the core mold 60. In this embodiment, one piston coupling boss 52 and eight magnets 51 are used. Accordingly, eight magnets 51 and one piston coupling boss 52 are prepared. The magnets 51 are initially non-magnetized magnets.

In the mold mounting step S200, the eight magnets 51 and the piston coupling boss 52 are assembled in the core mold 60. The core mold 60 is then mounted between an upper mold 70 and a lower mold 80 of the injection molding machine. The core mold 60 has a plurality of linear projections 61 (FIGS. 7A and 7B) that are formed on the outer circumference thereof. The linear projections 61 extend parallel to the axis of the core mold 60 and are spaced apart at equal intervals to accommodate the magnets 51. In order to magnetize the non-magnetic magnets 51, additional magnets 62 are disposed within the core mold 60. Further, a screw portion is formed at the center of the core mold 60, to secure the piston coupling boss 52. The piston operating assembly 50 of the present invention has less geometric error, for example, less error in concentricity, since a relatively shorter piston coupling boss 52 is secured thereto by injection molding. In contrast, in a conventional piston operating assembly, a longer piston is welded onto the linking member.

After the core mold 60 is mounted in the injection molding machine, the injection molding process begins. A molding resin is injected in the direction indicated by an arrow P in FIG. 8 into the core mold 60. The molding resin fills in the area of the core mold 60 that is indicated by the cross-hatching in FIG. 8 to surround the piston coupling boss 52 and the magnets 51. As a result, the integrated piston operating assembly 50 is formed at step S300. Gravity helps to draw the molding resin down through the gaps defined between the plurality of projections 61 of the core mold 60 to surround the magnets 51, so that the magnets 51 are fixedly secured by the molding resin.

After a predetermined time period, the molding resin solidifies and cools. At step S400 the completed piston operating assembly 50 is then removed from between the upper and lower molds 70 and 80, respectively, of the injection molding machine.

The present method for manufacturing the piston operating assembly 50 improves the geometric and assembly tolerances of the resulting piston operating assembly, by eliminating forceful coupling methods for securing the piston coupling boss and the magnets to the linking member. The magnets 51 and the coupling boss 52 are each coupled to the linking member 53 as the linking member 53 is injection molded.

Furthermore, the present method for manufacturing the piston operating assembly 50 for the linear compressor improves productivity, since the numerous assembly process steps are simplified by injection molding. The L-shaped cross-section of the magnets 51 secures the magnets to the linking member 53, thereby eliminating the need for a separate magnet cover. In addition, the piston is easily connected to the piston operating assembly 50, by matingly engaging the threads at the end of the piston with the screw portion 52*b* of the piston coupling boss 52.

As stated above, a preferred embodiment of the present invention is shown and described. Although the preferred embodiment of the present invention has been described, it is understood that the present invention should not be limited to this preferred embodiment. Various changes and modifications can be made by one skilled in the art within the spirit and scope of the present invention as hereinafter claimed.

What is claimed is:

1. A piston operating assembly for a linear compressor comprising:

a piston coupling boss for coupling to a piston;

a plurality of magnets disposed in a cylindrical arrangement concentric with respect to the piston coupling boss; and a linking member connecting and thus integrating the piston coupling boss and the plurality of magnets, the linking member being formed of an injection molded resin, wherein the piston coupling boss and the plurality of magnets are coupled to the linking member at the same time that the linking member is injection molded.

2. The piston operating assembly as claimed in claim 1, wherein each magnet has a stepped portion formed along a boundary thereof.

3. The piston operating assembly as claimed in claim 1, wherein the piston coupling boss is comprised of brass.

4. The piston operating assembly as claimed in claim 1, wherein the piston coupling boss includes a screw portion for engaging a threaded end of the piston.

* * * * *